US005515550A

United States Patent [19]

Friedman et al.

[11] Patent Number: 5,515,550

[45] Date of Patent: May 14, 1996

[54] REVERSIBLE APPAREL BELT

[75] Inventors: Harvey Friedman, Cranberry, N.J.; Michele Bagley, Chicago, Ill.

[73] Assignee: Humphreys Inc., Chicago, Ill.

[21] Appl. No.: 243,682

[22] Filed: May 16, 1994

[51] Int. Cl.[6] ..... A41F 3/02

[52] U.S. Cl. ..... 2/338; 2/311

[58] Field of Search ..... 2/311, 312, 338, 2/339, 325, 322, 323

[56] References Cited

U.S. PATENT DOCUMENTS

| | | | |
|---|---|---|---|
| D. 231,053 | 4/1974 | Bryant . | |
| 594,201 | 11/1897 | Frothingham . | |
| 670,726 | 3/1901 | Pierce | 2/322 |
| 722,316 | 3/1903 | Moody . | |
| 784,891 | 3/1905 | Saart . | |
| 1,392,319 | 10/1921 | Frank . | |
| 1,431,846 | 10/1922 | Slavens . | |
| 1,719,145 | 7/1929 | Stover . | |
| 1,792,158 | 2/1931 | Gleckner . | |
| 2,449,425 | 9/1948 | Stieger . | |
| 2,691,172 | 10/1954 | Breslow . | |
| 2,885,684 | 5/1959 | Dye et al. . | |
| 3,154,960 | 11/1964 | Creswell . | |
| 4,447,913 | 5/1984 | Engelson . | |
| 4,617,685 | 10/1986 | Grandis . | |
| 4,639,948 | 2/1987 | Adell . | |
| 5,000,243 | 3/1991 | Pepa . | |

*Primary Examiner*—C. D. Crowder
*Assistant Examiner*—Gloria Hale
*Attorney, Agent, or Firm*—Crowell & Moring

[57] ABSTRACT

A reversible apparel belt having a plurality of interconnected links is disclosed. Each link is formed from two pieces of flexible sheet material which are fastened together. The outside surface of the first piece of flexible sheet material differs in appearance from the outside surface of the second piece of flexible sheet material. The front face of the belt is formed from the outside surfaces of the first pieces of flexible sheet material and the back face of the belt is formed from the outside surfaces of the second pieces of flexible material so as to provide a reversible belt.

7 Claims, 3 Drawing Sheets

REVERSIBLE APPAREL BELT

BACKGROUND OF THE INVENTION

The present invention relates to link belts for use as personal apparel.

Many link belts are known in the prior art. Such belts are generally formed by connecting together a series of links, each of which is made from a single piece of leather. Thus, the link belts that are known in the prior art have the same appearance on both the front and back faces of the belt.

It is therefore an object of the invention to provide a reversible link belt having a front face which has a different appearance from the back face, so that the belt can be worn with either the front or back facing outward.

This and other objects and advantages of the invention will be apparent from the following detailed description of the invention, the drawings, and the claims. The drawings disclose the preferred embodiment of the reversible belt of the invention according to the best mode contemplated at the present time for carrying out the invention.

SUMMARY OF THE INVENTION

In accordance with the present invention, there is provided a reversible apparel belt having a plurality of links connected together. Each link is formed from two pieces of flexible sheet material which are fastened together. The outside surface of the first piece of flexible sheet material differs in appearance from the outside surface of the second piece of flexible sheet material. The front face of the belt is formed from the outside surfaces of the first pieces of flexible sheet material and the back face of the belt is formed from the outside surfaces of the second pieces of flexible material.

DETAILED DESCRIPTION OF THE INVENTION

The invention will now be described in detail with reference to the preferred embodiment of the reversible apparel belt.

Figure 1:
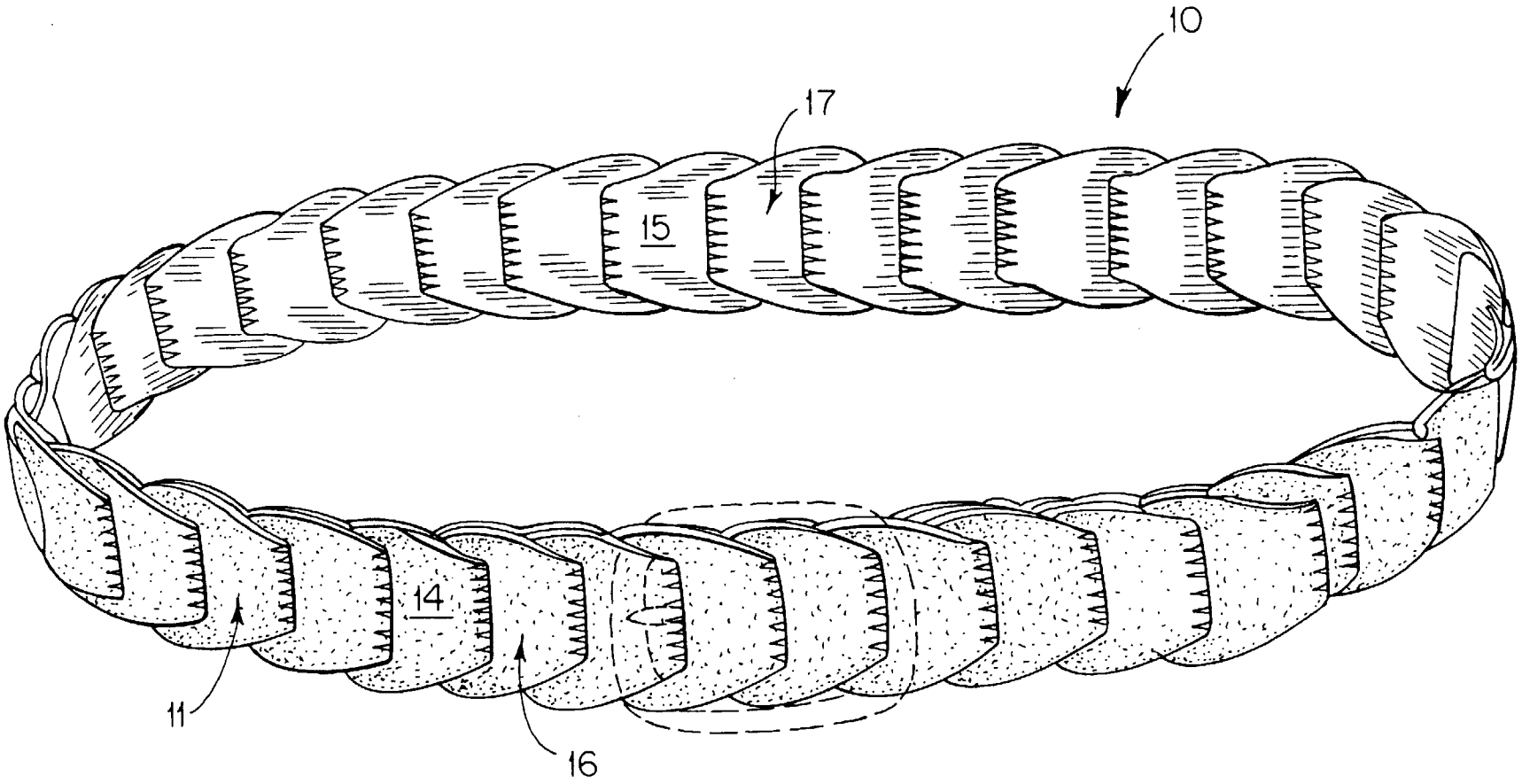
FIG. 1 is an elevational view of the preferred embodiment of the reversible apparel belt of the invention.

The preferred embodiment of the reversible apparel belt of the invention, as shown in FIG. 1, has a plurality of links 11, which are connected together to form belt 10.

Figure 3:
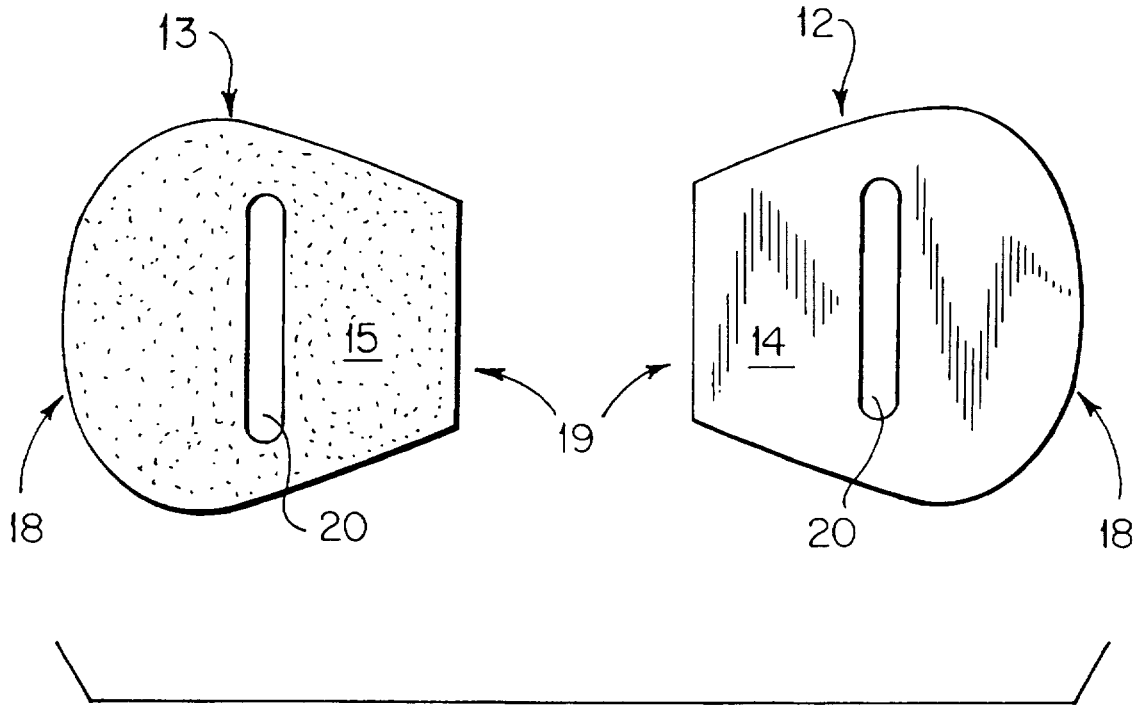
FIG. 3 shows one of the links used to form the preferred embodiment of the reversible belt of the invention.
Figure 4:
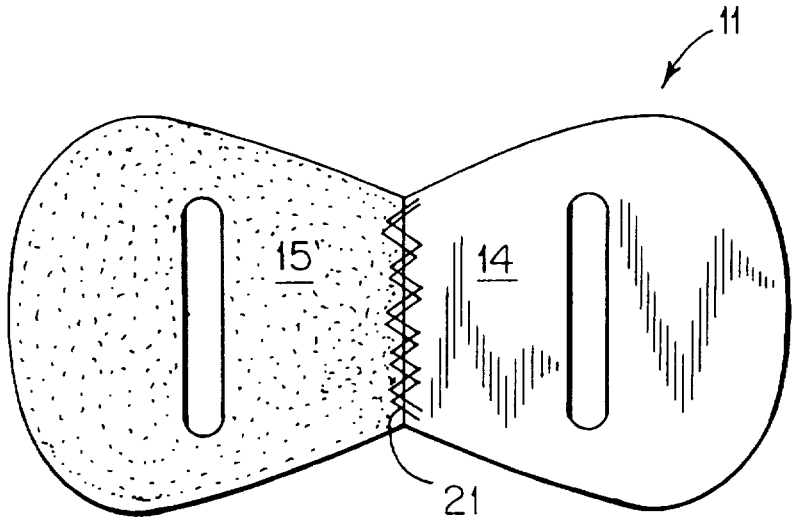
FIG. 4 shows a portion of one of the links used to form the preferred embodiment of the reversible belt of the invention.

According to the preferred embodiment of the reversible belt of the invention, as shown in FIGS. 3 and 4, each link 11 is formed from a first piece of flexible sheet material 12 which is fastened to a second piece of flexible sheet material 13. The flexible sheet material may be leather, vinyl, plastic, or other material. The preferred flexible sheet material is leather. The outside surface 14 of the first piece of flexible material 12 differs in appearance from the outside surface 15 of the second piece of flexible material 13. For example, where the flexible sheet material is leather, the outside surface 14 of the first piece of flexible material 12 may be smooth leather, while the outside surface 15 of the second piece of flexible material 13 may be napped leather (suede).

As shown in FIG. 1, the preferred embodiment of the reversible apparel belt of the invention has a front face 16 formed from the outside surfaces 14 of the first pieces of flexible sheet material 12 and a back face 17 formed from the outside surfaces 15 of the second pieces of flexible material 13. Thus, the front face 16 of belt 10 has a different appearance from the back face 17 of the belt, and the belt may be worn with either the front face 16 or the back face 17 facing outward.

As shown in FIG. 3, in the preferred embodiment of the reversible apparel belt of the invention, each of the pieces of flexible sheet material 12, 13 has substantially the same inner and outer peripheral shape. The outer peripheral shape preferably includes a U-shaped curved edge 18 and a substantially straight edge 19. The inner peripheral shape includes an elongated slit 20 positioned parallel to substantially straight edge 19. The elongated slit 20 is preferably positioned about halfway between substantially straight edge 19 and curved edge 18 opposite substantially straight edge 19.

As shown in FIG. 4, in the preferred embodiment of the reversible apparel belt of the invention, the first piece of flexible sheet material 12 is fastened to the second piece of flexible sheet material 13 along substantially straight edge 19 to form a seam 21. The pieces of flexible sheet material 12, 13 may be fastened together by any means, preferably by zigzag stitching. The pieces of flexible sheet material 12, 13 are fastened together so that the outside surface 14 of the first piece of flexible sheet material 12 is adjacent to the outside surface 15 of the second piece of flexible sheet material. Thus, each link 11 is formed from two pieces of flexible material 12, 13 which are fastened together.

Figure 2:
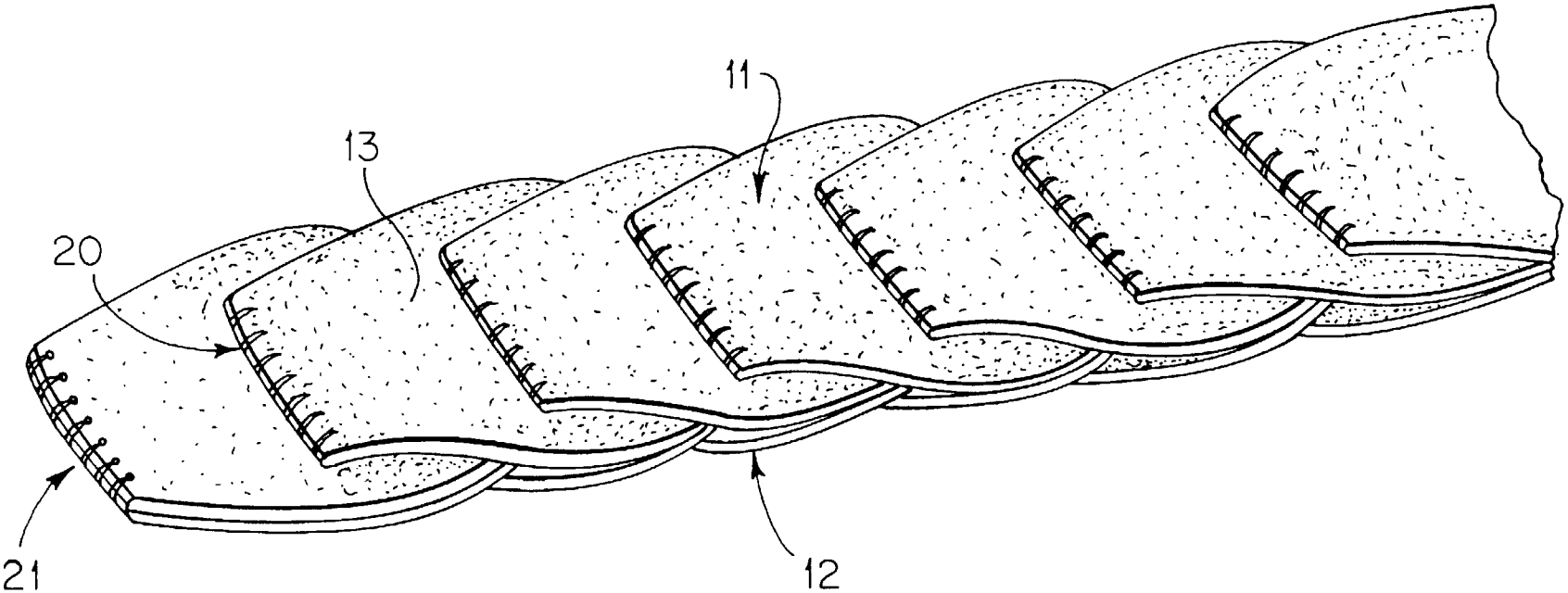
FIG. 2 is a side elevational view of a section of the preferred embodiment of the reversible belt of the invention.

According to the preferred embodiment of the reversible apparel belt of the invention, as best shown in FIG. 2, each link 11 is connected to an adjacent link by folding a first link along seam 21 such that the inside surface of the first piece of flexible sheet 12 material faces the inside surface of the second piece of flexible sheet material 13, and elongated slit 20 of the first piece of flexible sheet material 12 is aligned with the elongated slit 20 of the second piece of flexible sheet material 13. A second link 11 is then passed through the aligned slits 20 of the first link 11 so that seam 21 of the second link lines up with the aligned slits 20 of the first link. The second link 11 is then folded along its seam 20 so that the inside surface of the first piece of flexible sheet material 12 faces the inside surface of the second piece of flexible sheet material 13 and the elongated slit 20 of the first piece of flexible sheet material 12 is aligned with the elongated slit 20 of the second piece of flexible sheet material 13. Additional links 11 may be added to the chain in the same manner to form belt 10 having any desired length.

A buckle or other fastening means may be attached to either or both ends of the reversible link belt in a conventional manner. The reversible belt of the invention may be adapted to be worn around a person's waist, or as suspenders.

While a preferred embodiment of the invention has been disclosed, it will be appreciated by those skilled in the art that other embodiments of the invention within the scope of the following claims may be developed based on the principles disclosed herein.

We claim:

1. A reversible apparel belt comprising a plurality of links connected together and having a front face and a back face which have different appearances, wherein:

each of said plurality links is formed from a first piece of flexible sheet material and a second piece of flexible sheet material;

each piece of flexible sheet material has an inside surface and an outside surface and substantially the same inner and outer peripheral shape, said outer peripheral shape comprising at least one substantially straight edge and said inner peripheral shape comprising an elongated slit positioned parallel to said at least one substantially straight edge and about halfway between said at least one substantially straight edge and an edge opposite said at least one substantially straight edge, said outside surface of said first piece of flexible sheet material having a different appearance from said outside surface of said second piece of flexible sheet material;

each of said plurality of links is formed by fastening said first piece of flexible sheet material to said second piece of flexible sheet material along said at least one substantially straight edge to form a seam such that said outside surface of said first piece of flexible sheet material is adjacent to said outside surface of said second piece of flexible sheet material;

each of said plurality of links is folded along said seam such that said inside surface of said first piece of flexible sheet material faces said inside surface of said second piece of flexible sheet material and said elongated slit of said first piece of flexible sheet material is aligned with said elongated slit of said second piece of flexible sheet material, and each of said plurality of links is connected to an adjacent link by passing through the aligned slits of said adjacent link; and said front face of said belt is formed from said outside surfaces of said first pieces of flexible sheet material, and said back face of said belt is formed from said outside surfaces of said second pieces of flexible material.

2. The apparel belt according to claim 1, wherein said outer peripheral shape comprises a U-shaped curve.

3. The apparel belt according to claim 1, wherein said first and second pieces of flexible sheet material are fastened together by zigzag stitching.

4. The apparel belt according to claim 1, wherein said belt has a buckle and is adapted to be worn around a person's waist.

5. The apparel belt according to claim 1, wherein said flexible sheet material is leather.

6. The apparel belt according to claim 5, wherein said outside surface of said first piece of leather is smooth, and said outside surface of said second piece of leather is napped.

7. The apparel belt according to claim 5, wherein said outside surface of said first piece of leather has a first color, and said outside surface of said second piece of leather has a second color.

* * * * *